US007403128B2

(12) United States Patent
Scuka et al.

(10) Patent No.: US 7,403,128 B2
(45) Date of Patent: Jul. 22, 2008

(54) ADVERSE CONDITION DETECTOR WITH DIAGNOSTICS

(75) Inventors: Rodney W. Scuka, Dublin, OH (US); Timothy D. Kaiser, Plain City, OH (US); Paul J. Baker, Dublin, OH (US)

(73) Assignee: Maple Chase Company, Farmington, CT (US)

( * ) Notice: Subject to any disclaimer, the term of this patent is extended or adjusted under 35 U.S.C. 154(b) by 175 days.

(21) Appl. No.: 11/352,780

(22) Filed: Feb. 13, 2006

(65) Prior Publication Data

US 2006/0192680 A1 Aug. 31, 2006

Related U.S. Application Data

(60) Provisional application No. 60/653,808, filed on Feb. 17, 2005.

(51) Int. Cl.
*G08B 17/10* (2006.01)

(52) U.S. Cl. ..... 340/632; 340/506; 340/628; 340/517

(58) Field of Classification Search ..... 340/632, 340/506, 628, 517, 521, 539.22, 539.26, 340/286.05, 577, 541, 825.36, 7.52, 7.59, 340/825.45
See application file for complete search history.

(56) References Cited

U.S. PATENT DOCUMENTS 4,668,939 A 5/1987 Kimura et al.
5,806,071 A 9/1998 Balderrama et al.
5,920,258 A * 7/1999 Kusyk et al. ..... 340/506
6,317,718 B1 11/2001 Fano
6,484,150 B1 11/2002 Blinn et al.
6,529,908 B1 3/2003 Piett et al.
6,546,002 B1 4/2003 Kim
6,661,340 B1 12/2003 Saylor et al.
6,671,655 B2 12/2003 Moccio
6,701,352 B1 3/2004 Gardner et al.
6,862,589 B2 3/2005 Grant
6,914,534 B2 * 7/2005 Tanguay ..... 340/628

FOREIGN PATENT DOCUMENTS

GB 2 356 933 11/1999

* cited by examiner

*Primary Examiner*—Anh V La
(74) *Attorney, Agent, or Firm*—Andrus, Sceales, Starke & Sawall, LLP

(57) ABSTRACT

An adverse condition detector that records historical data concerning the operation of the detector such that the detector can be interrogated by a technician. The microprocessor of the adverse condition detector monitors for alarm conditions and other important information related to the operation of the detector. Upon identifying an important characteristic of the detector operation, the microprocessor time stamps the information and stores the information within memory of the microprocessor. The detector includes an interface pad that is accessible from the exterior of the detector such that a technician can access the interface pad without removing the detector housing.

19 Claims, 3 Drawing Sheets

ADVERSE CONDITION DETECTOR WITH DIAGNOSTICS

CROSS REFERENCE TO RELATED APPLICATION(S)

The present application is based on and claims priority to U.S. Provisional Patent Application Ser. No. 60/653,808 filed on Feb. 17, 2005.

BACKGROUND OF THE INVENTION

The present invention generally relates to adverse condition detectors, such as smoke detectors, carbon monoxide detectors and combination units. More specifically, the present invention relates to an adverse condition detector that includes the ability to store historical information regarding the alarms generated based on the adverse condition detected and other information regarding the operation of the detector.

Currently available adverse condition detectors, such as carbon monoxide alarms for residential homes, detect a level of carbon monoxide in the area surrounding the alarm device and operate a transducer, such as an audible horn, to indicate to the home occupant that a hazardous level of carbon monoxide has been detected. Similar detectors are available for the detection of smoke and combination units are available that detect both smoke and carbon monoxide.

In the current available adverse condition detecting devices, the detecting device includes little to no capacity to record historical data as to how the detector is operating. As an example, some currently available carbon monoxide detectors display the maximum carbon monoxide concentration detected. However, the detector cannot be interrogated by field service personnel or at the manufacturing facility after a product recall to determine additional information regarding the operation of the detector. Such additional information may include the carbon monoxide buildup, the number of times the alarm was activated or reset. This information may be useful to a service technician. As an example, if a service technician was able to determine the date and time of all of the generated alarms, the technician could determine whether the alarm generating issues are periodic or alternatively that the carbon monoxide increased very slowly over time.

Therefore, it is an object of the present invention to provide an adverse condition detector that includes the ability to store historical information regarding the operation of the adverse condition detector and provide service technicians the ability to download and analyze this historical data. This data can also be used by the manufacturing company to identify any weak points in the detector design.

SUMMARY OF THE INVENTION

The present invention is an adverse condition detector that records the occurrence of various monitored events such that the occurrence of the monitored events can be retrieved by an external interrogating device. The method of operating the adverse condition detector allows the external interrogating device to retrieve the stored monitored events such that trained technicians and service personnel can determine how the adverse condition detector was operating in the field.

The adverse condition detector includes an enclosed housing that surrounds a microprocessor having an internal clock. The microprocessor is in communication with at least a first adverse condition detection circuit that is operable to detect the presence of an adverse condition, such as the presence of smoke or carbon monoxide. When the adverse condition detection circuit detects the presence of an adverse condition or some other related monitored event, the microprocessor within the housing records the occurrence of the monitored event and a time stamp. The time stamp recorded along with the occurrence of the monitored event relates the time of the monitored event occurrence to the initial start-up of the adverse condition detector. Thus, if the date and time the adverse condition detector was placed into operation is known, the time stamp can be used to relate the recorded event to real time.

The adverse condition detector further includes an interface pad that is coupled to the microprocessor such that the microprocessor can receive information through the interface pad and transmit information to an external interrogating device through the interface pad. In the preferred embodiment of the invention, the interface pad is included within the enclosed housing. Preferably, the enclosed housing includes a series of openings that allow interface pins to extend through the housing and contact the interface pad. The external interrogating device is able to communicate to the microprocessor through the interface pad such that information can be received from the external interrogating device and transmitted back to the interrogation device through the interface pad.

The adverse condition detector is initially placed in a location to be monitored and the internal clock within the microprocessor is activated, such as through the initial application of a power supply. Once the internal clock of the microprocessor has been activated, the adverse condition detector monitors for the occurrence of one of a series of monitored events related to the operaiton of the adverse condition detector.

Once one of the monitored events has been detected, the value of the monitored event is recorded in the microprocessor along with a time stamp. The time stamp recorded along with the occurrence of the monitored event is the value of the internal clock upon the occurrence of the event. The monitored events and time stamps are continuously recorded within the memory of the microprocessor during the lifetime of the detector operation.

If historical data needs to be recovered from the detector, the microprocessor can be interrogated by an external interrogation device. Specifically, interrogating pins from the interrogating device are placed into contact with the interface pad coupled to the microprocessor. The external interrogation device and the microprocessor can communicate to each other through the interface pad, such as with a serial communication protocol. Alternatively, the communication between the microprocessor and the external interrogation device can be completed using wireless communication techniques.

In addition to recording the occurrence of monitored events, the adverse condition detector can include various counters that are incremented each time the monitored event occurs. The value of each of the occurrence counters can be obtained from the detector by the external interrogation device.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
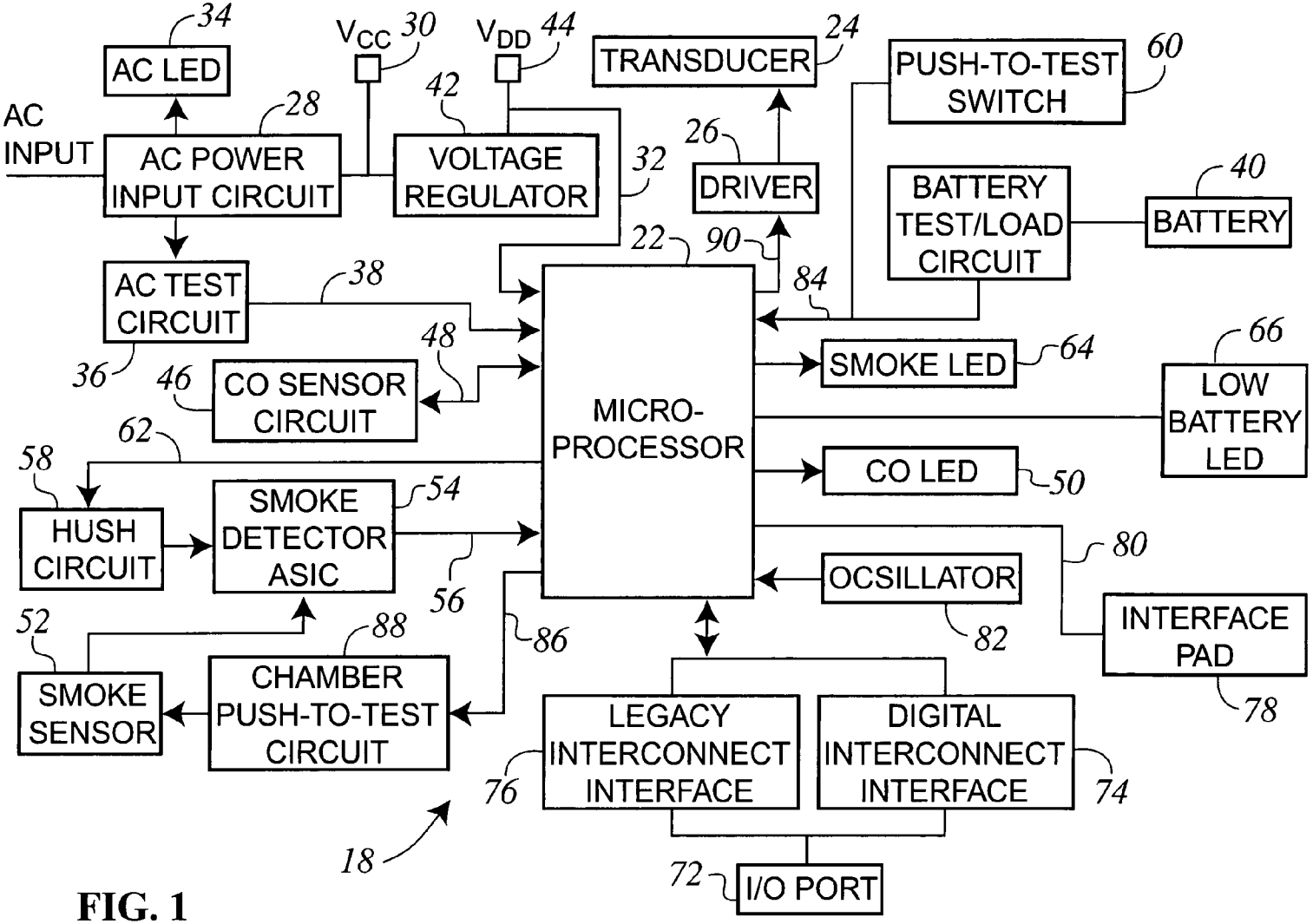
FIG. 1 is an overall schematic illustration of a combination smoke and carbon monoxide adverse condition detector.

Referring now to FIG. 1, thereshown is a block diagram of an adverse condition detector 18 of the present invention. As described, the adverse condition detector 18 of the present invention is a combination smoke and CO detector.

The adverse condition detector 18 includes a central microprocessor 22 that controls the operation of the adverse condition detector 18. In the preferred embodiment of the invention, the microprocessor 22 is available from Atmel Mega 32, although other microprocessors could be utilized while operating within the scope of the present invention. The block diagram of FIG. 1 is shown on an overall schematic scale only, since the actual circuit components for the individual blocks of the diagram are well known to those skilled in the art and form no part of the present invention.

As illustrated in FIG. 1, the adverse condition detector 18 includes an alarm indicator or transducer 24 for alerting a user that an adverse condition has been detected. Such an alarm indicator or transducer 24 could include but is not limited to a horn, a buzzer, siren, flashing lights or any other type of audible or visual indicator that would alert a user of the presence of an adverse condition. In the embodiment of the invention illustrated in FIG. 1, the transducer 24 comprises a piezoelectric resonant horn, which is a highly efficient device capable of producing an extremely loud (85 dB) alarm when driven by a relatively small drive signal.

The microprocessor 22 is coupled to the transducer 24 through a driver 26. The driver 26 may be any suitable circuit or circuit combination that is capable of operably driving the transducer 24 to generate an alarm signal when the detector detects an adverse condition. The driver 26 is actuated by an output signal from the microprocessor 22.

As illustrated in FIG. 1, an AC power input circuit 28 is coupled to the line power within the facility. The AC power input circuit 28 converts the AC power to an approximately 9 volt DC power supply, as indicated by block 30 and referred to as $V_{CC}$. The adverse condition detector 18 includes a green AC LED 34 that is lit to allow the user to quickly determine that proper AC power is being supplied to the adverse condition detector 18.

The adverse condition detector 18 includes a voltage regulator 42 that is coupled to the 9 volt $V_{CC}$ 30 and generates a 3.3 volt supply $V_{DD}$ as available at block 44. The voltage supply $V_{DD}$ is applied to the microprocessor 22 through the input line 32, while the power supply $V_{CC}$ operates many of the detector-based components as is known.

In the embodiment of the invention illustrated in FIG. 1, the adverse condition detector 18 is a combination smoke and carbon monoxide detector. The detector 18 includes a carbon monoxide sensor circuit 46 coupled to the microprocessor 22 by input line 48. In the preferred embodiment of the invention, the CO sensor circuit 46 includes a carbon monoxide sensor that generates a carbon monoxide signal on input line 48. Upon receiving the carbon monoxide signal on line 48, the microprocessor 22 determines when the sensed level of carbon monoxide has exceeded one of many different combinations of concentration and exposure time (time-weighted average) and activates the transducer 24 through the driver 26 as well as turning on the carbon monoxide LED 50.

In the preferred embodiment of the invention, the microprocessor 22 generates a carbon monoxide alarm signal to the transducer 24 that is distinct from the alarm signal generated upon detection of smoke. The specific audible pattern of the carbon monoxide alarm signal is an industry standard and is thus well known to those skilled in the art.

In addition to the carbon monoxide sensor circuit 46, the adverse condition detector 18 includes a smoke sensor 52 coupled to the microprocessor through a smoke detector ASIC 54. The smoke sensor 52 can be either a photoelectric or ionization smoke sensor that detects the presence of smoke within the area in which the adverse condition detector 18 is located. In the embodiment of the invention illustrated, the smoke detector ASIC 54 is available from Allegro as Model No. A5368CA and has been used as a smoke detector ASIC for numerous years.

When the smoke sensor 52 senses a level of smoke that exceeds a selected value, the smoke detector ASIC 54 generates a smoke signal along line 56 that is received within the central microprocessor 22. Upon receiving the smoke signal, the microprocessor 22 generates an alarm signal to the transducer 24 through the driver 26. The alarm signal generated by the microprocessor 22 has a pattern of alarm pulses followed by quiet periods to create a pulsed alarm signal as is standard in the smoke alarm industry. The details of the generated alarm signal will be discussed in much greater detail below.

As illustrated in FIG. 1, the adverse condition detector 18 includes a hush circuit 58 that quiets the alarm being generated by modifying the operation of the smoke detector ASIC 54 upon activation of the test switch 60. If the test switch 60 is activated during the generation of the alarm signal due to smoke detection by the smoke sensor 52, the microprocessor 22 will output a signal on line 62 to activate the hush circuit 58. The hush circuit 58 adjusts the smoke detection level within the smoke detector ASIC 54 for a selected period of time such that the smoke detector ASIC 54 will moderately change the sensitivity of the alarm-sensing threshold for the hush period. The use of the hush circuit 58 is well known and is described in U.S. Pat. Nos. 4,792,797 and RE33,920, incorporated herein by reference.

At the same time the microprocessor 22 generates the smoke alarm signal to the transducer 24, the microprocessor 22 activates LED 64 and provides a visual indication to a user that the microprocessor 22 is generating a smoke alarm signal. Thus, the smoke LED 64 and the carbon monoxide LED 50, in addition to the different audible alarm signal patterns, allow the user to determine which type of alarm is being generated by the microprocessor 22. The detector 18 further includes a low-battery LED 66.

When the microprocessor 22 receives the smoke signal on line 56, the microprocessor 22 generates an interconnect signal through the IO port 72. In the preferred embodiment of the invention, the interconnect signal is delayed after the beginning of the alarm signal generated to activate the transducer 24. However, the interconnect signal could be simultaneously generated with the alarm signal while operating within the scope of the present invention. The IO port 72 is coupled to the common conduit 20 (FIG. 1) such that multiple adverse condition detectors 18 can be joined to each other and sent into an alarm condition upon detection of an adverse condition in any of the adverse condition detectors 18.

Referring back to FIG. 1, the adverse condition detector 18 includes both a digital interconnect interface 74 and a legacy interconnect interface 76 such that the microprocessor 22 can both send and receive two different types of signals through the IO port 72. The digital interconnect interface 74 is utilized with a microprocessor-based adverse condition detector 18 and allows the microprocessor 22 to communicate digital information to other adverse condition detectors through the digital interconnect interface 74 and the IO port 72.

As an enhancement to the adverse condition detector 18 illustrated in FIG. 1, the legacy interconnect interface 76 allows the microprocessor 22 to communicate to so-called "legacy alarm" devices. The prior art legacy alarm devices issue a continuous DC voltage along the interconnect common conduit 20 to any interconnected remote device. In the event that a microprocessor-based detector 18 is utilized in the same system with a prior art legacy device, the legacy interconnect interface 76 allows the two devices to communicate over the IO port 72.

An oscillator 82 is connected to the microprocessor 22 to control the internal clock within the microprocessor 22, as is conventional.

During normal operating conditions, the adverse condition detector 18 includes a push-to-test system 60 that allows the user to test the operation of the adverse condition detector 18. The push-to-test switch 60 is coupled to the microprocessor 22 through input line 84. When the push-to-test switch 60 is activated, the voltage $V_{DD}$ is applied to the microprocessor 22. Upon receiving the push-to-test switch signal, the microprocessor generates a test signal on line 86 to the smoke sensor via chamber push-to-test circuit 88. The push-to-test signal also generates appropriate signals along line 48 to test the CO sensor and circuit 46.

The chamber push-to-test circuit 88 modifies the output of the smoke sensor such that the smoke detector ASIC 54 generates a smoke signal 56 if the smoke sensor 52 is operating correctly, as is conventional. If the smoke sensor 52 is operating correctly, the microprocessor 22 will receive the smoke signal on line 56 and generate a smoke alarm signal on line 90 to the transducer 24.

As discussed previously, upon depression of the push-to-test switch 60, the transducer 24 generates an alarm signal. Since the transducer 24 of the present invention is a piezoelectric horn that generates an extremely loud audible alarm, a need and desire exists for the transducer 24 to generate a "scaled down" alarm signal that is not as annoying and painful to a user who is near the transducer. In prior art systems, such as those embodied by U.S. Pat. No. 6,348,871, the amplitude of the alarm signal is reduced for at least a portion of the initial period of the alarm signal to prevent the loud alarm signal from being generated near the user's ears. As discussed previously, this type of system has perceived drawbacks in that the transducer 24 may sound different or unusual when operated at less than the full signal amplitude.

As illustrated in FIG. 1, the adverse condition detector 18 includes an interface 78 connected to the microprocessor 22 by the communication line 80. In the embodiment of the invention illustrated in FIG. 2, the interface 78 is a jumper that allows an external device, such as a PDA or portable PC, to communicate with the microprocessor 22 using serial communications. The interface 78 can include interface pins or pads 92 on the jumper which can be coupled to a communication cable from either a PDA or a portable PC.

As described above and as set forth below, the diagnostic tool, such as a PDA or PC, communicates with the adverse condition detector using a hard wired serial connection. However, it should be understood that other communication protocols such as RS 232, RS 485, USB, Blue Tooth, TCP/IP and IRDA are contemplated as being other types of communication methods between the detector and the diagnostic device.

In accordance with the present invention, the microprocessor 22 is configured to include operating software that allows the microprocessor to collect historical data regarding operation of the adverse condition detector. It is contemplated that when the adverse condition detector is initially powered up, the microprocessor 22 will include an internal clock that begins counting. The clock will keep track of the time expired from the initial power-up such that conventional calendar time and date information can be determined based on the time and date the detector was placed into service. The microprocessor 22 includes internal operating software that time stamps various readings taken from the smoke detector ASIC 54 and the carbon monoxide sensor circuit 46. For example, when the level of carbon monoxide sensed exceeds a threshold level, the microprocessor 22 records and stores the carbon monoxide level with a time stamp. Likewise, when the smoke detector ASIC 54 detects a level of smoke above a threshold value, the microprocessor 22 again stores the time when the detection occurred along with the level of smoke detected. It is contemplated that the microprocessor 22 could be configured to record and store numerous events that occur within the adverse condition detector. In addition to storing time-stamp information, the microprocessor can be configured to include multiple counters that record the number of times various alarm-specific events occur. Listed below are the various events/counters that are currently contemplated as being monitored within the adverse condition detector of the present invention, although other events and counters are contemplated:

EventCounters

SC01 Total number of internal resets since cleared
SC02 Total number of external resets since cleared
SC03 Total number of Memory Errors fixed
SC04 Total number of Memory Errors found
SC05 Push Button Counter
SC06 Number CO Alarms
SC07 Number Smoke Alarms
SC08 Number CO above 70 PPM Minutes
SC09 CO Above 150 PPM Minutes
SC0A Number Remote Smoke Events
SC0C Number Faults Although the above list indicates eleven different detector functions that are monitored and stored in memory, it is contemplated that various other events could be monitored and stored within the microprocessor 22. As described, when each of the events occur, the event is time stamped such that the occurrence of the event can be correlated to the initial power up of the adverse condition detector.

Listed below is an example of the data that can be collected from the adverse condition detector of the present invention:

CO reading in ppm.
% COHbt reading.
Smoke reading in % obscuration per foot.
$V_{DD}$ reading in $V_{DC}$.
$V_{BATT}$ reading in $V_{DC}$.
Temperature reading in counts.
Time reading in seconds.

As described, when each of the events occur, the event is time stamped such that the occurrence of the event can be related back to the initial power up of the adverse condition detector.

In the preferred embodiment of the invention, the microprocessor 22 will continue to store the various events discussed above, each having a time stamp indicating when the event occurred relative to the time the detector was placed into service. If the detector is operating normally, the detection events will not ever need to be retrieved by either a field service technician or by the manufacturer. However, if the detector malfunctions or alarms due to detected conditions at a higher than expected rate, a field service technician can interrogate the microprocessor 22 in the field or the entire detector can be returned to the manufacturer for interrogation.

Figure 3:
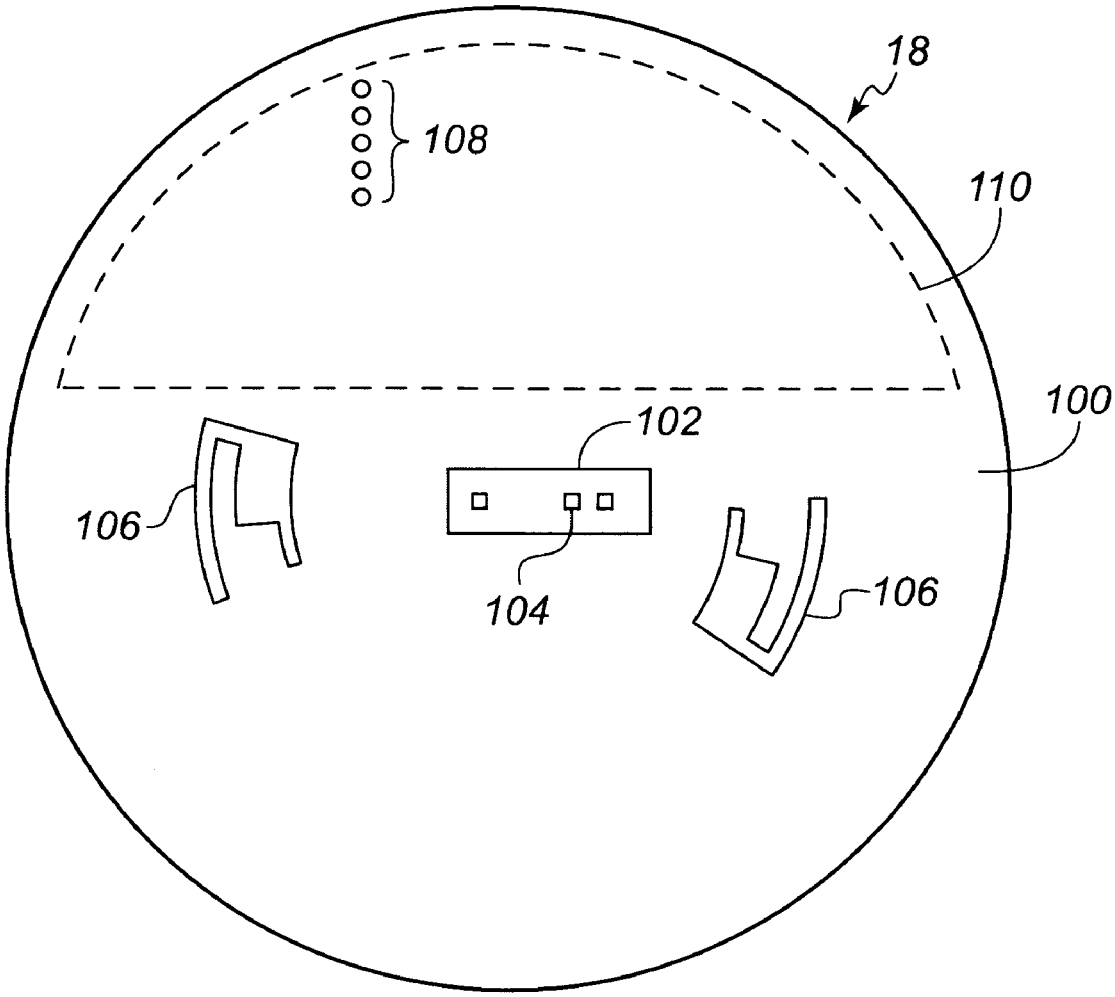
FIG. 3 is a back view of an adverse condition detector including a series of pin openings for interrogating the detector without removing the outer housing.

Referring now to FIG. 3, thereshown is the back surface 100 of the outer housing of a detector 18. Preferably, the outer housing is formed from a molded plastic material. The back surface 100 includes a power receptacle 102 having a series of pins 104 that connect to the line power for the building in which the detector 18 is installed. The back surface 100 includes a series of mounting tabs 106 for positioning the detector in the desired location. The detector back surface 100 further includes a series of pin openings 108 that extend through the plastic housing that defines the back surface 100.

Figure 2:
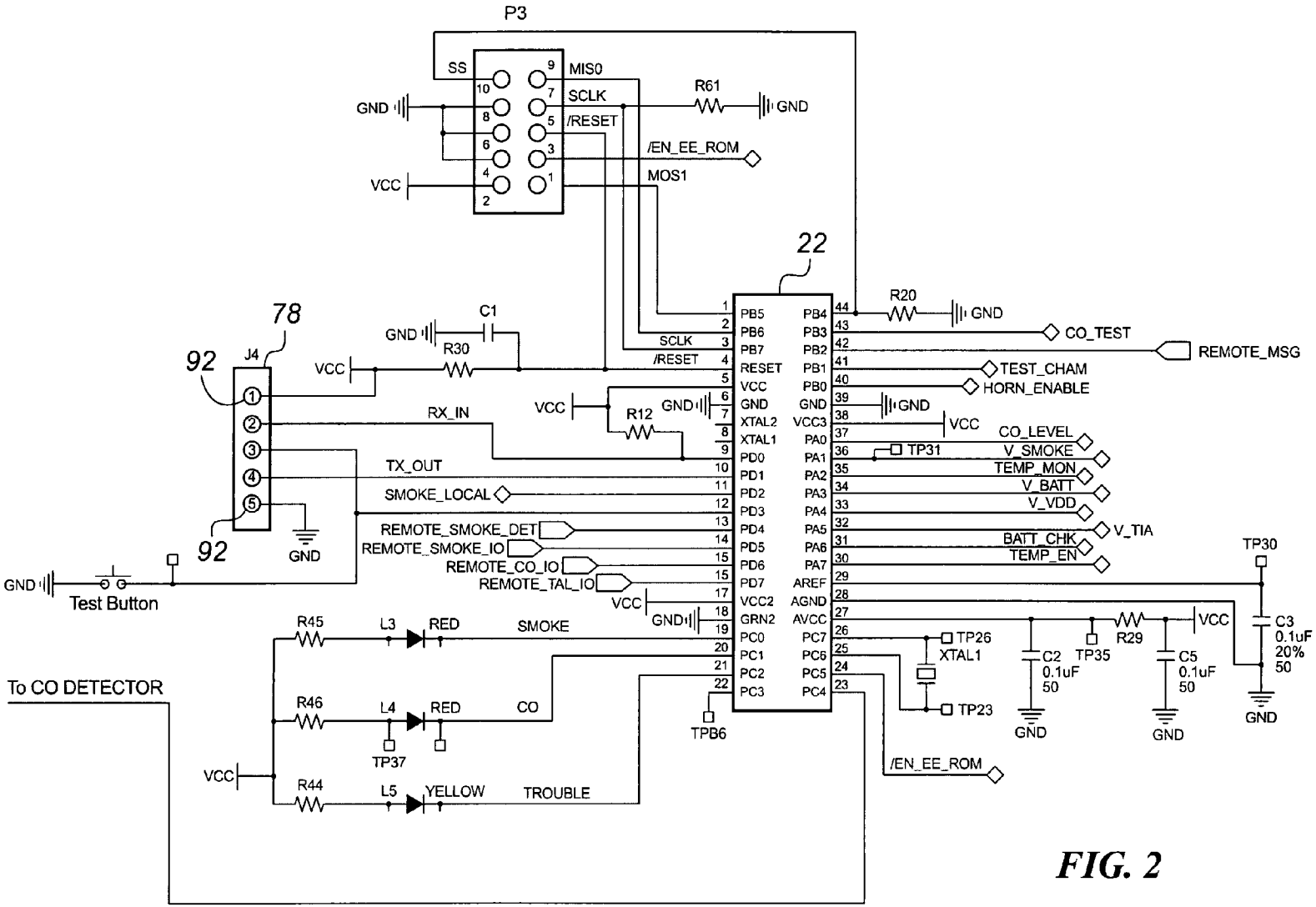
FIG. 2 is a detailed circuit schematic showing the inner face pad that allows an external device to obtain historical data stored within the microprocessor of the adverse condition detector.

As shown in FIG. 3, the back surface 100 includes five pin openings 108 that correspond to the five interface pins 92 included on the interface pad 78 shown in FIG. 2. The detector 18 is configured such that the interface pad 78 is positioned directly behind the pin openings 108 such that external pins can be inserted through the pin openings 108 to contact the interface pads 92 contained on the interface pad 78. Thus, the interface pad 78 contained within the housing of the smoke detector can be accessed by using a series of pins that extend through the pin openings 108. In this manner, the internal microprocessor 22 can be interrogated without removing the housing of the detector. In addition, it is contemplated that the jumper can also be utilized to reprogram the microprocessor of the detector by using the series of pin openings 108.

In the preferred embodiment of the invention, an information label 110 is applied to the back surface 100 to provide operating instructions to the user while covering the pin openings 108. When the detector needs to be interrogated, the label 110 can be removed or the interrogation pins can be inserted through the label and into the pin openings 108. After the detector has been interrogated, another adhesive label 110 can be applied to the back surface of the detector.

It is contemplated that the detector will be interrogated by various types of computer equipment, such as a desktop computer, laptop computer, or PDA. Preferably, the communication will take place utilizing a serial interface, although other communication protocols are clearly contemplated as being within the scope of the invention. If wireless communication protocols are utilized, such as Bluetooth or IRDA, the interface pad 78 and pin openings 108 can be eliminated.

During the interrogation process, the message sent between the microprocessor of the detector and the interrogating device can have various different types of message formats while operating within the scope of the present invention. Listed below is a contemplated structure for the messages sent between the microprocessor 22 and the external interrogating device through the interface pad 78.

| Preamble | Command/Response | DATA | Checksum | Terminator |
|---|---|---|---|---|
| 2 bytes | 1 byte | 0 to 64 bytes | 1 byte | 1 byte (optional) |
| $I | | | | 0x0D |

The Preamble field for a message consists of 2 bytes "$I" that is 0x24, 0x49. The I says that the protocol is based on the SPI port. The protocol's definition says that it should be "$R" if it is based on the UART port.
The Command/Response field is only 1 byte in length. For a Read command it is set to 'R' (read) or 0x52, a read response sets it to 'r' or 0x72. A Write command sets this field to 'W' or 0x57, a write response sets it to 'w' or 0x77.
The DATA field for a command is the BLOB TABLE entry and the item number._For example: MF is the blob table entry for the manufacturing flag. It only has one entry, so it is ok to use the item number as 00. Therefore MF00 means the manufacturing flag. $IRMF00 is the start of a command to read the Manufacturing flag.
The Checksum is calculated by 1's complementing the sum of the command and data fields. It is represented by a 2-byte ASCII character format. Since there are no addressing or sequence bytes in this protocol, a message to read a Blob Table Entry will always have the same checksum.
The optional Terminator is defined to be 0x0D.

Shown above is the message structure for the information sent from the microprocessor to the external interrogating device through the interface 78. The preamble of each message is a field that contains two bytes that indicates the protocol for the message. The command/response field is only one byte in length and allows the message to indicate whether the command is a read command or a write command. The data field can include from 0-64 bytes and allows the processor to communicate the different events and the time at which the events occurred to the external interrogation device. The check sum section provides the ability to check the complete list of the data transferred.

Listed below is a sample of the messages included in the DATA field that, along with the time stamp information, can be sent from the adverse condition detector to the external device, such as a PDA or PC:

```
'AP'  AlarmFlags,
      AP01 boolean SmokeAlarm;
      AP02 boolean COalarm;
      AP03 boolean TestInProcess;
'CI'  EEPROM__ADDR(sCustInfo),(46 bytes of info)
      CI01 uint8 acName[CUST__NAME__SIZE];/* Customer name */
      CI02 uint8 acAddr[CUST__ADDR__SIZE]; /* Customer street address */
      CI03 uint8 acZip[CUST__ZIP__SIZE];     /* Customer ZIP code */
'CM'  EEPROM__ADDR(sCtlInfo), (47 bytes of info)
      CM01 uint8 acManID[CTL__MAN__ID__SIZE];     /* Manufacturer ID */
      CM02 uint8 acModelNo[CTL__MODEL__NO__SIZE];     /* Model number */
      CM03 uint8 acSerNum[CTL__SER__NUM__SIZE];     /* Serial number */
      CM04 uint8 acSwRev[CTL__SW__REV__SIZE];     /* S/W revision */
      CM05 uint8 acDateCode[CTL__DATE__CODE__SIZE];     /* S/W date code */
'DI'  EEPROM__ADDR(sDealerInfo),(32 bytes of info)
      DI01 uint8 acAccNo[DEAL__ACC__SIZE];     /* Account number */
      DI02 uint8 acDialUpNo[DEAL__DIALUP__SIZE];     /* Dial-up number */
      DI03 uint8 sInstDate[INST__DATE__SIZE];     /* Installation date */
      DI04 uint8 acLastSvcDate[LAST__SVC__DATE__SIZE];     /* Last service date */
'DS'  &sCurrSystemStatusMsg,
      DS01 uint8 cNewFault;     /* New Controller Fault Code     */
      DS02 boolean bSmokeTestInProcess; /* Unit in a Smoke Test     */
```

-continued

```
        DS03 uint8 cBatteryLevel;        /* Battery Level in Smoke Detector */
        DS04 uint8 cProvisionCommand;       /* Provisioning Command        */
        DS05 boolean bHushRequested;       /* Hush requested on detector        */
        DS06 boolean bResetCORequested;        /* Reset requested for CO        */
'F1'    &sSortedExc[0-4],
'F2'    &sSortedExc[5-9],
'F3'    &sSortedExc[10-14],
'F4'    &sSortedExc[15-19],
        FX01 Exception code
        FX02 Module that detected exception
        FX03 Exception time (controller run time)
        FX04 Controller mode at time of exception
'SC'    EventCounters (Each counter is 16 bits)
        SC01 Total number of internal resets since cleared
        SC02 Total number of external resets since cleared
        SC03 Total number of Memory Errors fixed
        SC04 Total number of Memory Errors found
        SC05 Push Button Counter
        SC06 Number CO Alarms
        SC07 Number Smoke Alarms
        SC08 Number CO above 70 PPM Minutes
        SC09 CO Above 150 PPM Minutes
        SC0A Number Remote Smoke Events
        SC0C Number Faults
'SM'    EEPROM_ADDR(sSysInfo)
        SM01 uint8 acManID[SYS_MAN_ID_SIZE];        /* Manufacturer ID */
        SM02 uint8 acModelNo[SYS_MODEL_NO_SIZE];        /* Model number */
        SM03 uint8 acSerNum[SYS_SER_NUM_SIZE];        /* Serial number */
        SM04 uint8 acManRev[SYS_MAN_REV_SIZE];        /* Manufacturing revision */
        SM05 uint8 acManDate[SYS_MAN_DATE_SIZE];        /* Manufacturing date */
'DC'    detectorinfo,(DATA COLLECT INFORMATION)
      /* CO Information */
        DC01 uint32 CohbLevel;
        DC02 uint32 CurrentTime;
        DC03 uint32 LastCOReadTime;
        DC04 uint16 rawco;
        DC05 uint16 COppm;
        DC06 byte COselftestflag;
        DC07 byte COalarm;
        DC08 byte HushtimeInProcess;
        DC09 uint32 CO_Alarm_Level;
      /* Other Information */
        DC0A uint16 temperature;
        DC0B uint16 batteryvoltage;
        DC0C uint16 VDD_Voltage;
        DC0D uint16 SmokeVoltage;
        DC0E uint16 TIAVoltage;
        DC0F uint16 BadRMTMsgs;
        DC10 ModeType mode;    (Mode Type is a single byte in length)
        DC11 uint16 HushSmokeLevel;
        DC12 uint16 AlarmSmokeLevel
        DC13 uint16 Flags        (for definition of Flags, see below)
        DC14 uint16 nSmokeLevel
'CO'    COppm, current CO level (2 bytes in length)
'ST'    TimeForSelfTest, Time that Self Test is scheduled (4 bytes in length)
'TM'    RESERVED
```

As an example, if the technician wishes to request the current CO reading for the detector, the ASCII string $IRCO003B is sent to the microprocessor of the detector. In this interrogation message, the first two characters $I specify that the protocol is based on the SPI port. The third character R signifies the message is a read command. The next two characters CO request that the current CO level be returned by the microprocessor.

The detector will respond with the ASCII string $Ir00CO00XXXXYY. The response from the detector will include the current CO reading in the places marked with "X". The characters YY are the checksum values.

In addition to reading information from the detector, the communication protocol between the detector and the external interrogation device can also be used to change various operating parameters of the detector, such as the manufacturing flag or other relevant information.

As can be understood by the above description, the ability of the adverse condition detector to store historic information regarding different events that occurred within the detector allows the service technician the ability to diagnose both the detector and its surroundings. This ability allows for better placement of the detector and the ability to diagnose the surrounding area. As an example, in the case of a CO detector, the technician would be able to determine whether fuel burning appliances, such as water heaters, boilers, clothes dryers, furnaces, fireplaces, stoves and other devices were operating improperly in the area surrounding the adverse condition detector. The ability to monitor the timing of the alarm events and the frequency of these occurrences would aid the technician in analyzing the operation of the devices in the immediate area. Further, since smoke and CO detectors signal adverse conditions occurring within the home, the storage of historical data would allow a service technician to determine if an alarm condition occurred when the home was unoccupied and thus no knowledge of the alarm condition was known.

We claim:

1. A method of operating an adverse condition detector including at least an adverse condition detection circuit and a microprocessor contained within a housing, the method comprising the steps of:

activating an internal clock within the microprocessor upon the initial activation of the adverse condition detector;

operating the microprocessor within the adverse condition detector to monitor for the occurrence of one of a series of monitored events related to the operation of the adverse condition detector;

recording the occurrence of the monitored event and a time stamp within the microprocessor of the adverse condition detector, the time stamp being the value of the internal clock upon the occurrence of the monitored event; and interrogating the microprocessor to extract the recorded occurrences of the monitored events and the associated time stamps.

2. The method of claim 1 further comprising the step of providing an interface pad on the adverse condition detector in communication with a microprocessor.

3. The method of claim 2 wherein the microprocessor is interrogated by an external communication device coupled to the interface pad.

4. The method of claim 3 wherein the microprocessor and the interface pad are contained within the housing, the housing having a series of pin openings aligned with the interface pad such that interface pad is accessible through the housing.

5. The method of claim 1 wherein the adverse condition detection circuit is a carbon monoxide detection circuit and the series of monitored events include the detection of carbon monoxide concentration levels above a selected threshold.

6. The method of claim 2 further comprising the step of downloading parameters to the microprocessor through the interface pad.

7. The method of claim 1 further comprising the step of incrementing an occurrence counter upon the occurrence of a monitored event, wherein the microprocessor can be interrogated to extract the value of the occurrence counter.

8. The method of claim 1 wherein the adverse condition detector includes both a carbon monoxide detection circuit and a smoke detection circuit, wherein the monitored events include at least the actuation of a smoke alarm and the actuation of a carbon monoxide alarm.

9. The method of claim 1 wherein the step of interrogating the microprocessor includes:

receiving an information request from an external communication device through the interface pad; and generating a message including the requested information to the interface pad.

10. The method of claim 1 wherein the monitored event and the time stamp are stored in non-volatile memory of the microprocessor.

11. The method of claim 1 wherein the monitored event and the time stamp are stored in non-volatile memory external to the microprocessor.

12. An adverse condition detector comprising:

an enclosed housing;

a microprocessor contained within the housing and including an internal clock;

at least a first adverse condition detection circuit contained within the housing and coupled to the microprocessor and operable to detect the presence of an adverse condition; and an interface pad contained within the housing and coupled to the microprocessor such that the microprocessor can receive information through the interface pad and transmit information to an external communication device through the interface pad, wherein the microprocessor is operable to monitor for the occurrence of a monitored event and record both the occurrence of the monitored event detected by the adverse condition detection circuit and a time stamp, wherein the time stamp is the value of the internal clock upon the occurrence of the monitored event.

13. The adverse condition detector of claim 12 wherein the adverse condition detection circuit is a carbon monoxide detection circuit.

14. The adverse condition detector of claim 12 wherein the adverse condition detection circuit is a smoke detection circuit.

15. The adverse condition detector of claim 12 wherein the housing includes a series of pin openings aligned with the interface pad such that the interface pad is accessible from the exterior of the housing through the pin openings.

16. The adverse condition detector of claim 12 further comprising a second adverse condition detection circuit operable to detect the presence of a second adverse condition.

17. The adverse condition detector of claim 12 wherein the internal clock of the microprocessor is actuated upon the initial activation of the adverse condition detector.

18. The adverse condition detector of claim 12 wherein the detector further comprises a non-volatile memory located external to the microprocessor.

19. The adverse condition detector of claim 12 wherein the microprocessor includes non-volatile memory for storing the occurrence of the monitored event and the time stamp.

* * * * *